US006904726B2

(12) United States Patent
Heard et al.

(10) Patent No.: US 6,904,726 B2
(45) Date of Patent: Jun. 14, 2005

(54) WINDOW AND DOOR FRAME BRICKMOULD HAVING INTEGRAL J-CHANNEL

(76) Inventors: Robert F. Heard, 3452 Sean Way, Lawrenceville, GA (US) 30044; Larry J. Heard, 4676 Westchester Ct. NE., Duluth, GA (US) 30136

( * ) Notice: Subject to any disclaimer, the term of this patent is extended or adjusted under 35 U.S.C. 154(b) by 262 days.

(21) Appl. No.: 09/759,579

(22) Filed: Jan. 12, 2001

(65) Prior Publication Data

US 2002/0059760 A1 May 23, 2002

Related U.S. Application Data

(60) Provisional application No. 60/176,212, filed on Jan. 14, 2000.

(51) Int. Cl.[7] ..... E06B 1/04

(52) U.S. Cl. ..... 52/211; 52/204.53; 52/204.54; 52/215; 52/287.1; 52/312; 52/718.04; 49/504

(58) Field of Search ..... 512/211, 212, 512/217, 287.1; 49/504

(56) References Cited

U.S. PATENT DOCUMENTS

| | | | | |
|---|---|---|---|---|
| 1,170,968 A | | 2/1916 | Elgin | |
| 2,663,390 A | | 12/1953 | Dordel | |
| 3,139,703 A | | 7/1964 | Hilt | |
| 4,189,885 A | | 2/1980 | Fritz | |
| 4,389,824 A | | 6/1983 | Anderson | |
| 4,608,800 A | | 9/1986 | Fredette | |
| 4,875,318 A | | 10/1989 | MacLeod et al. | |
| 4,920,709 A | | 5/1990 | Garries et al. | |
| 5,018,325 A | | 5/1991 | Geen et al. | |
| 5,022,204 A | | 6/1991 | Anderson | |
| 5,058,323 A | * | 10/1991 | Gerritsen | 49/504 |
| 5,090,174 A | | 2/1992 | Fragale | |
| D325,980 S | | 5/1992 | Hall | |
| 5,115,605 A | | 5/1992 | Butler | |
| 5,182,880 A | * | 2/1993 | Berge, Jr. et al. | 49/504 |
| 5,282,344 A | | 2/1994 | Moore | |
| 5,349,799 A | | 9/1994 | Schiedegger et al. | |
| 5,392,574 A | | 2/1995 | Sayers | |
| 5,444,954 A | | 8/1995 | Anderson | |
| 5,579,617 A | | 12/1996 | Schiedegger et al. | |
| 5,581,970 A | | 12/1996 | O'Shea | |
| 5,586,415 A | | 12/1996 | Fisher et al. | |
| 5,660,010 A | | 8/1997 | Sayers | |
| 5,669,192 A | | 9/1997 | Opdyke et al. | |
| 5,829,206 A | | 11/1998 | Bachman | |
| 5,836,123 A | | 11/1998 | Gulino | |
| 5,850,717 A | | 12/1998 | Schiedegger et al. | |
| 5,924,259 A | | 7/1999 | Marousek | |
| 5,966,880 A | * | 10/1999 | Bridges et al. | 52/211 |
| 6,125,605 A | * | 10/2000 | Young | 52/717.01 |
| 6,148,582 A | * | 11/2000 | Ellingson | 52/656.4 |
| 6,212,835 B1 | * | 4/2001 | Schiedegger et al. | 52/211 |
| 6,276,101 B1 | * | 8/2001 | Schiedegger et al. | 52/211 |

* cited by examiner

*Primary Examiner*—Carl D. Friedman
*Assistant Examiner*—Yvonne M. Horton
(74) *Attorney, Agent, or Firm*—Myers & Kaplan, LLC; Barry E. Kaplan; Ashish D. Patel

(57) ABSTRACT

A fenestration brickmould having an integral J-channel formed therein, along with a fastening and flashing flange extending therefrom, such that the brickmould may be attached to the perimeter of the fenestration assembly and may become an integral part thereof. Accordingly, the fenestration assembly, in combination with the brickmould of the present invention, preferably are attached to the frame of the building as a single unit. The J-channel is formed between the flange and the decoratively molded portion for receiving a variety of sidings, including, but not limited to, vinyl, cementious siding, and wood. The present invention eliminates the need for separate J-channel attachments when utilizing vinyl siding.

7 Claims, 1 Drawing Sheet

WINDOW AND DOOR FRAME BRICKMOULD HAVING INTEGRAL J-CHANNEL

RELATED APPLICATIONS

Figure 1:
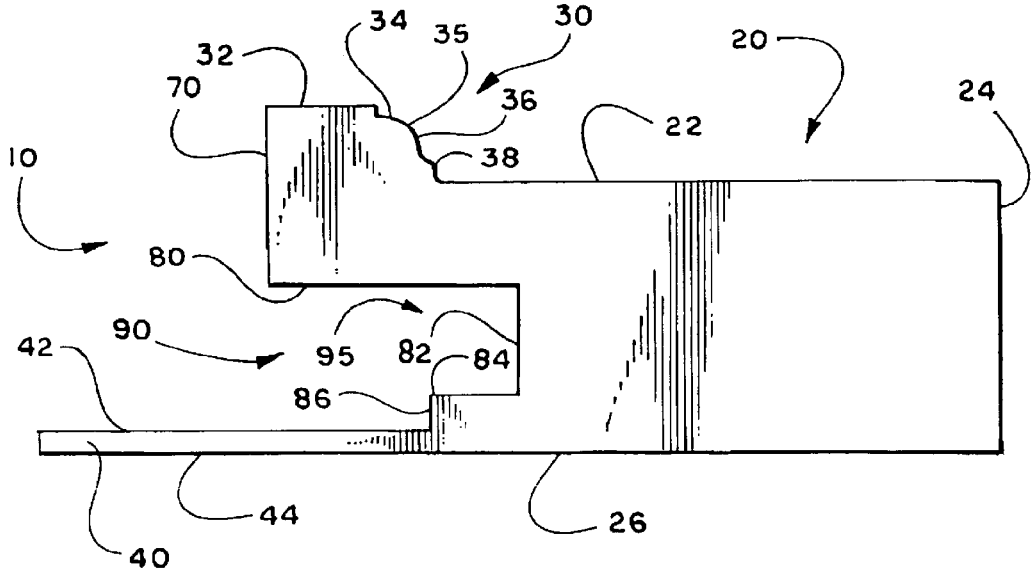

This non-provisional patent application claims the benefit of Provisional Patent Application Ser. No. 60/176,212, filed on Jan. 14, 2000.

TECHNICAL FIELD

The present invention relates generally to the improvement of building construction and, more specifically, to a window and door frame brickmould having an integral J-channel formed therein.

BACKGROUND ART

For many years, residential fenestrations, such as windows and doors, were made exclusively out of wood. In order to nail the window or door into an opening, a decorative 2"×1¼" piece of wood is typically applied to the exterior perimeter of the window or door jamb. Prior to installation, the piece of wood is run through a molder, wherein a decorative profile is applied into the face of the wood. So that customers can mix and match inventory from different suppliers, the National Wood Window and Door Association standardized the decorative profile. This well known profile generally comprises a lower flat portion and a raised flat portion separated by an angled stepped portion, wherein the angled stepped portion generally comprises two steps having a middle arcuate section. This type of molding is commonly known as brickmoulding.

The window or door assembly is then installed into position by nailing through the lower flat portion of the brickmoulding and into the frame. After the window is installed, brick, siding, or stucco is installed on the exterior walls, butting against the brickmould. In an attempt to reduce the likelihood of the infiltration of water into the wall and thus possible water damage, caulk is applied in the joint between the brick, siding, or stucco and the brickmoulding. Additionally, flashing is often installed between said junction as a supplemental water barrier.

In recent years, a desire for less expensive home building materials and more maintenance-free exteriors brought about the use of vinyl siding. However, because vinyl siding is thin and flexible and often cut unevenly on the job site, it cannot be adequately butted against traditional brickmould. Consequently, vinyl siding manufacturers have provided channeled attachment members known as J-channel, wherein the J-channel is nailed onto the exterior wall around all doors, windows, and vents through a nailing fin or flange. The edge of the siding is then inserted into the pocket of the J-channel. However, the edge of the J-channel still butts against the brickmould; thus, resulting in the increase potential for water infiltration and/or the need for caulking.

Because of the consumer appeal of brickmoulding, even with the advent of steel doors, and aluminum and vinyl windows, wood brickmoulding is often still utilized around the perimeter as decorative trim. However, if vinyl siding is used, J-channel attachments must still be incorporated. As a result, most vinyl windows have incorporated J-channel into their window frames; thereby, eliminating the use of brickmoulding and the need for nailing separate J-channel attachments. Consequently, the consumer is unable to enjoy the benefits and appeal of brickmoulding. Moreover, it is commonly accepted that J-channel is unattractive and distracts from the aesthetics of the building.

In addition to the above prior art deficiencies, approximately ten years ago, the U.S. Federal Government did two things that helped create a need for the present invention. More specifically, because brickmould has traditionally been made of wood, it is susceptible to moisture damage. However, to minimize moisture damage, the wood was treated with a relatively effective preservative that, if painted soon after it was installed, would provide relatively good preservation. However, the Environmental Protection Agency found that chemicals used in the preservative may prove harmful to the environment and forced the industry to change to a much less effective preservative. Additionally, to protect old-growth timber, the U.S. Federal Government placed restrictions on the harvesting of these timbers. Consequently, the wood mills have been forced to use much shorter pieces of wood and to make long pieces out of many short pieces by a means known as "finger jointing". More specifically, many fingers are cut into the ends of the wood so they fit in male/female fashion with glue utilized to join the union. However, there is often open areas in the joints; thus, allowing moisture to seep into the joint area. When the brickmould is painted, the moisture is sealed in and the wood rots from the inside.

It is, therefore, readily apparent that a new and improved window and door frame brickmould having an integral J-channel formed therein is needed that reduces the risk of moisture damage, reduces the need for caulking and flashing, and can be utilized with vinyl siding, wood siding, cementious siding, stucco, brick, and other exterior coverings. It is, therefore, to the provision of such an improvement that the present invention is directed.

BRIEF SUMMARY OF THE INVENTION

Briefly described, in a preferred embodiment, the present invention both overcomes the above-mentioned disadvantages, and meets the recognized needs for such device, by providing a window and door frame brickmould having an integral J-channel formed therein.

In the preferred embodiment, the present invention is attached to the perimeter of the fenestration assembly and becomes an integral part thereof, such that the fenestration assembly in combination with the present invention is attached to the frame of the building as a single unit.

More specifically, in a preferred embodiment, the present invention comprises a generally elongated rectangular solid portion having a flat surface. Extending from one side of the solid portion is a raised molded portion having a raised flat portion separated from the solid portion by an angled stepped portion, wherein the angled stepped portion generally comprises two steps having a middle arcuate section. This type of molding is commonly known as brickmoulding.

Extending from the opposite side of the solid portion in the same direction as and parallel with the molded portion is a flange. The flange extends past the molded portion and serves as both a nailing flange for installing the window or door and as flashing to prevent the infiltration of water.

A channel is formed between the flange and the molded portion for receiving a multitude of various sidings, including, but not limited to, vinyl, cementious siding, and wood. A portion of the channel is generally J-shaped for better receiving vinyl siding. As a result, the present invention eliminates the need for separate J-channel attachments when utilizing vinyl siding.

Although the present invention may be formed from any of a variety of materials, in the preferred embodiment, cellular polyvinyl chloride (PVC) is preferred to provide the necessary structural support and the aesthetic appeal of wood, without the risk of moisture damage.

Thus, it is an object of the present invention to provide a new and improved window and door brickmoulding having an integral J-channel formed therein for receiving vinyl siding.

It is another object of the present invention to provide a new and improved window and door brickmoulding that can be secured to a fenestration assembly and installed therewith.

It is still another object of the present invention to provide a new and improved window and door brickmoulding that is formed from cellular PVC and is, thus, resistant to water damage and is relatively maintenance free.

It is yet another object of the present invention to provide a new and improved window and door brickmoulding having a flanged portion formed as an integral part thereof, wherein the flange portion serves as both a nailing surface and as flashing; thus, reducing the need for caulking and additional flashing.

It is yet still another object of the present invention to provide a new and improved window and door brickmoulding that reduces the overall cost of building construction.

It is a further object of the present invention to provide a new and improved window and door brickmoulding that is formed in continuous portions; thus, eliminating the need for excessive numbers of finger joints and, thereby, reducing the risk of moisture infiltration.

Other objects, features, and advantages of the present invention will become apparent to those ordinarily skilled in the art by reference to the accompanying Drawing Figures and to the Detailed Description of the Preferred Embodiment presented herein.

BRIEF DESCRIPTION OF THE FIGS.

Figure 2:
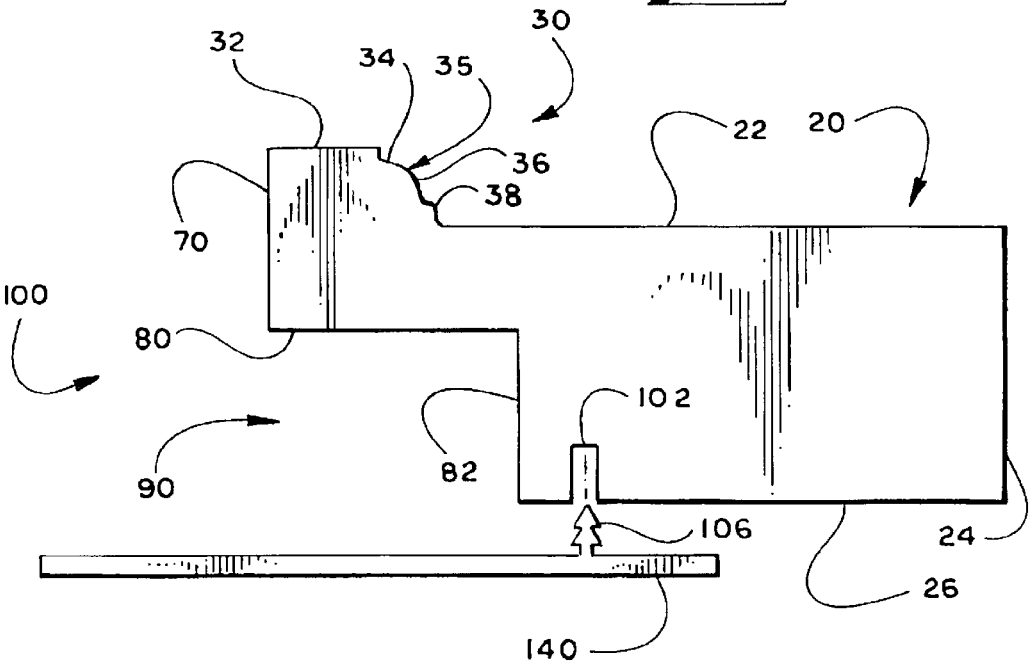

The present invention will be better understood by reading the Detailed Description of the Preferred Embodiment with reference to the accompanying drawing Figures, in which like reference numerals denote similar structure and refer to like elements throughout, and in which:

FIG. 1 is a side view of the brickmould according to a preferred embodiment of the present invention; and, FIG. 2 is a side view of the brickmould according to an alternate embodiment of the present invention.

DETAILED DESCRIPTION OF THE PREFERRED EMBODIMENT

In describing the preferred and alternate embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

With reference first to FIG. 1, device 10 generally comprises elongated solid rectangular portion 20, raised molded portion 30, and flange portion 40. More specifically, molded portion 30 extends generally from top side 22 of rectangular portion 20. Molded portion 30 preferably comprises raised flat portion 32 separated from top side 22 of rectangular portion 20 by angled stepped portion 35, wherein angled stepped portion 35 generally comprises first step 34 and second step 38 separated by middle arcuate section 36. This type and shape of molding is commonly known as brickmoulding.

Extending from bottom side 26 of rectangular portion 20 in the same direction as and parallel with top side 22 is flange 40. Bottom surface 44 of flange 40 is preferably inline with bottom side 26 of rectangular portion 20. Flange 40 preferably extends beyond molded portion 30 and serves as both a nailing flange, or fin, for installing the fenestration, such as a window or door, and as flashing to prevent the infiltration of water.

The thickness of flange 40 is less than the thickness of rectangular portion 20, thereby forming channel 90 between flange 40 and molded portion 30 for receiving any of a variety of sidings, including, but not limited to, vinyl, and wood. Raised step portion 84 is formed partially along top surface 42 of flange 40 and within channel 90 to create generally J-shaped channel 95, wherein J-shaped channel 95 has a smaller width than channel 90. J-shaped channel 95 is dimensioned to receive the end portion of widely utilized vinyl siding, wherein the vinyl siding frictionally rests between bottom surface 80 of molded portion 30 and raised step portion 84, and against side wall 82 of rectangular portion 20.

Channel 90 is dimensioned for receiving other well-known siding materials such as, for exemplary purposes only, cementious siding or wood. The end of the cementious siding or wood frictionally rests between bottom surface 80 of molded portion 30 and top surface 42 of flange 40, and against lip 86 of raised step portion 84.

In use, device 10 preferably is attached to or formed as an integral part of a window or door assembly. Once the window or door is placed within the respective opening of the building frame, nails are driven through flange 40 and into the exterior walls to assist in securing the fenestration in place. As an added waterproofing means, the interface between the exterior wall and the outer edge of flange 40 can be caulked. If vinyl siding is utilized, the ends of the vinyl siding are slid into J-shaped channel 95 and then secured to the exterior wall. If cementious siding or wood siding is utilized, the end of the respective siding is slid into channel 90 and secured to the exterior wall, wherein the end of the siding rests against lip 86. So used, the present invention beneficially provides that any imperfections or inaccurate cuts on the end of the vinyl, cementious siding, or wood are hidden within channel 95 or channel 90, respectively.

Additionally, if stone, brick, or stucco is utilized, the respective material is placed over flange 40 and abutted against edge 70 of molded portion 30. As a result, flange 40 serves as both a mounting flange and as flashing.

In an alternate embodiment, as shown in FIG. 2, device 100 comprises all of the same elements and features as device 10, except that flange 40 and step portion 84 are removed. In lieu of flange 40, a flexible vinyl sheet 140 is provided. Vinyl sheet 140 may further be provided with barbs 106. Kerf 102 may be formed into device 100 to cooperatively accept and engage barbs 106. So provided, vinyl sheet 140 serves as an alternative to flange 40. In use, nails are driven through flange 140 and into the exterior walls to assist in securing the fenestration in place. As an added waterproofing means, the interface between the exterior wall and the outer edge of flange 140 can be caulked. If vinyl siding is utilized, the ends of the vinyl siding are slid into J-shaped channel 90 so formed and then secured to the exterior wall.

As shown in FIG. 2, vinyl sheet 140 preferably is a thin-walled approximately linear sheet with sufficient structural stiffness to accommodate the installation requirements described more fully above. While the preferred alternate embodiment has been described with reference to FIG. 2, it is apparent that more than one vinyl sheet 140 may be used in abutting fashion to span device 100. It is further apparent that suitable step profiles, in the nature of those described hereinabove with reference to FIG. 1, may be provided within channel 90 in order to accommodate cementious siding or the like. Similarly, it is apparent that bottom side 26 may be modified to provide a step portion in order to accommodate sheet 140 in a manner such that the resulting joint is flush and water resistant. It is additionally apparent that barbs 106 may be formed as longitudinal projections of any defined length in order to better accommodate the manufacturing process. In lieu of barbs 106 and kerf 102, a vinyl sheet 140 provided without barbs 106 may be nailed, screwed, adhered, or otherwise attached by well-known means to bottom side 26.

In additional alternate embodiments, raised step portion 84 of FIG. 1 is removed and channel 90 is dimensioned to fit any of a variety of well-known sidings. It should be noted that although the shape of brickmoulding, as commonly known, is shown and described herein, the present invention is not limited to said described shape. Any of a variety of other shapes may be utilized.

Although device 10 may be formed from any of a variety of known materials such as, for exemplary purposes only, wood, aluminum, vinyl, and plastics, in the preferred embodiment, cellular PVC is preferred to provide the necessary structural support and the aesthetic appeal of wood, without the risk of moisture damage due to rot or decay.

It will be recognized by those ordinarily skilled in the art that channels 90, 95 advantageously provide a drainage trough arrangement whereby water may be channeled away from structural openings.

Advantageously, through use of flange portion 40 as a nailing/ fastening flange, unsightly nail punctures through the face of the brickmould are eliminated. It will also be recognized that flange portion 40 optionally may be provided with pre-formed holes or openings to accommodate nails or other fastener devices.

With regard to all such embodiments as may be herein described and contemplated, it will be appreciated that optional features, including, but not limited to, aesthetically pleasing coloration and surface design, and labeling and brand marking, may be provided in association with the present invention, all without departing from the scope of the invention.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

We claim:

1. A fenestration for receiving siding in association with an architectural structure, comprising:

a fenestration frame;

a brickmoulding affixed to said fenestration frame for receiving siding, comprising:

a rectangular portion comprising a width, a length, said length being greater than said width, and a thickness, said rectangular portion further comprising a bottom surface and a top surface, said bottom surface for overlying a building structure;

a flange portion carried in approximately parallel relationship by said bottom surface of said rectangular portion, said flange portion extending beyond said width of said rectangular portion; and, a channel for receiving siding, said channel being formed between said flange portion and said top surface;

said channel further comprising therewithin a step portion adjacent the bottom of said channel, whereby the channel so formed is adapted to cooperatively receive differing thicknesses of siding.

2. The fenestration of claim 1 wherein said top surface further comprises a decorative portion extending from and carried by said top surface.

3. The fenestration of claim 1 wherein said flange is formed integrally with said brickmoulding.

4. The fenestration of claim 1 wherein said flange is affixed thereto adjacent said bottom surface by a fastener.

5. The fenestration of claim 4 wherein said fastener comprises a cooperating barb and kerf.

6. The fenestration of claim 1 wherein said flange further comprises pre-formed holes or openings to receive a fastener.

7. The fenestration of claim 1 wherein said brickmoulding comprises cellular polyvinyl chloride.

* * * * *